US011994150B2

(12) United States Patent
Ejjabraoui

(10) Patent No.: US 11,994,150 B2
(45) Date of Patent: May 28, 2024

(54) CENTRIFUGAL PUMP OPERATION

(71) Applicant: Schneider Toshiba Inverter Europe SAS, Pacy sur Eure (FR)

(72) Inventor: Kamal Ejjabraoui, Gravigny (FR)

(73) Assignee: Schneider Toshiba Inverter Europe SAS, Pacy sur Eure (FR)

( * ) Notice: Subject to any disclaimer, the term of this patent is extended or adjusted under 35 U.S.C. 154(b) by 52 days.

(21) Appl. No.: 17/522,996

(22) Filed: Nov. 10, 2021

(65) Prior Publication Data

US 2022/0154732 A1 May 19, 2022

(30) Foreign Application Priority Data

Nov. 13, 2020 (EP) ..... 20306374

(51) Int. Cl.
*F04D 29/66* (2006.01)
*F04D 15/00* (2006.01)
*F04D 15/02* (2006.01)

(52) U.S. Cl.
CPC ..... *F04D 29/669* (2013.01); *F04D 15/0027* (2013.01); *F04D 15/0066* (2013.01); *F04D 15/0281* (2013.01)

(58) Field of Classification Search
CPC ..... F04D 15/0027; F04D 15/0066; F04D 15/0281; F04D 29/669
See application file for complete search history.

(56) References Cited

U.S. PATENT DOCUMENTS 6,663,349 B1 * 12/2003 Discenzo ..... F04D 15/0245 417/44.1
2001/0041139 A1 * 11/2001 Sabini ..... F04D 15/0066 417/18
2002/0146319 A1 * 10/2002 Dorsch ..... F04D 29/622 415/206
2011/0223038 A1 * 9/2011 Ogawa ..... F04D 15/0066 417/45
2014/0358818 A1 * 12/2014 Haga ..... G06F 30/00 705/343

FOREIGN PATENT DOCUMENTS

JP 2000110769 A 4/2000
JP 2020510154 A 4/2020
WO 2005080798 A1 9/2005
WO WO-2005080798 A1 * 9/2005 ..... F04D 15/0088

OTHER PUBLICATIONS

English translation of WO-2005080798-A1 obtained Jan. 26, 2023 (Year: 2005).*
European Search Report and Search Opinion dated Apr. 21, 2021 for corresponding European Patent Application No. EP20306374.8, 46 pages.

* cited by examiner

*Primary Examiner* — Connor J Tremarche
(74) *Attorney, Agent, or Firm* — Locke Lord LLP

(57) ABSTRACT

A method for controlling a hydraulic pumping system that includes a centrifugal pump operating at a functional point. The method uses parameters of the centrifugal pump at the functional point and end-of-lines characteristics of the centrifugal pump to determine an updated Net Positive Suction Head Required, $NPSH_r$, value.

15 Claims, 7 Drawing Sheets

CENTRIFUGAL PUMP OPERATION

FIELD OF THE INVENTION

This invention relates to a method for controlling a hydraulic pumping system. In particular, the invention relates to the avoidance of cavitation phenomena in centrifugal pumps.

BACKGROUND

A centrifugal pump is a pump which converts a rotation kinetic energy to a hydrodynamic energy of a fluid, using a motor. The fluid enters for example through a suction flange of the centrifugal pump and is accelerated by a plurality of blades of an impeller.

The centrifugal pumps can be subject to cavitation phenomena during their use. The cavitation can comprise two steps:

- a first step of creation of water vapor bubbles at an eye of an impeller due to a decreasing pressure of the fluid causing its vaporization,
- a second step of implosion of vapor bubbles inside a core of the centrifugal pump due to an increase of the fluid pressure causing the condensation of the bubbles.

The cavitation and in particular the vapor bubbles implosion causes mechanical damages, noise and vibrations of centrifugal pumps that can lead to permanent damage. In fact, cavitation can reduce the lifetime of pumps and increase their maintenance costs. Moreover, when cavitation phenomena appear, the power of the pump motor at a determined speed may be reduced compared to the pump nominal operation.

Some solutions may be considered to preserve centrifugal pumps from the cavitation.

For example, a solution is to compare the inlet pressure of the pump with a threshold and raise an alert when the inlet pressure falls under the threshold. However, the threshold does not correspond to the actual inlet pressure leading to cavitation.

Another solution is to detect the cavitation by monitoring the power of the motor in function of its speed and, when a significant power drop is detected (i.e. cavitation is detected), slowing the speed of a motor of the pump. This solution however implies that the cavitation does appear before slowing the speed of the motor to resorb the phenomenon, and thereby induce damage in the pump.

Still another solution is to have a Net Positive Suction Head Available (hereinafter called "$NPSH_a$") greater than a Net Positive Suction Head Required (hereinafter called "$NPSH_r$") at a functional point of the centrifugal pump. Both $NPSH_r$ and $NPSH_a$ correspond to a pressure at a suction flange of the centrifugal pump. The $NPSH_r$ is generally computed by the manufacturer and is a pump characteristic while the $NPSH_a$ is computed by the pump user and depends on the hydraulic system. The $NPSH_r$ is such that, at a functional point of the centrifugal pump, if a $NPSH_a$ value is greater than the $NPSH_r$, the cavitation should not appear or should not damage the centrifugal pump.

However, during the life of the centrifugal pump, the $NPSH_r$ curve provided by the manufacturer becomes less and less reliable as the hydraulic parameters of the pump change with time, the $NPSH_r$ curve design being dependent of the hydraulic parameters. Therefore, in long term, even in the case when the $NPSH_a$ is greater than the $NPSH_r$ provided by the manufacturer, cavitation causing irremediable damages can appear.

SUMMARY

An object of the present disclosure is therefore to propose a method for controlling a hydraulic pumping system avoiding that cavitation causing damages appears, in particular in cases of a used centrifugal pump.

Another object is to allow detecting a current or future cavitation of the centrifugal pump in order to raise alerts.

In order to reach these objects, the present disclosure proposes to determine an adapted $NPSH_r$ value of a centrifugal pump based on the evolution of hydraulic parameters of the centrifugal pump during its life and on end-of-line characteristics of the centrifugal pump. By adapted $NPSH_r$ value, we mean an updated value of NPSHr according to the evolution of the hydraulic parameters of the centrifugal pump during its life. The adapted $NPSH_r$ value may therefore replace the $NPSH_r$ value computed when the centrifugal pump was new in order to prevent the cavitation of the centrifugal pump at each moment of its life.

The present disclosure describes a computer implemented method for controlling a hydraulic pumping system, the system comprising a centrifugal pump operating at a functional point, the method comprising:

- estimating a suction pressure of the centrifugal pump representing a pressure at an entry point of the centrifugal pump;
- estimating a discharge pressure of the centrifugal pump representing a pressure at an exit point of the centrifugal pump;
- computing a current head of the centrifugal pump based on the suction pressure and on the discharge pressure;
- determining a theoretical head based on a value of a specific functional parameter linked to the functional point of the centrifugal pump in the system and on end-of-line characteristics of the centrifugal pump;
- computing a head difference between the current head and the theoretical head; and
- determining, for the functional point, an adapted Net Positive Suction Head Required value, $aNPSH_r$, of the centrifugal pump, based on the head difference and on the end of-line characteristics.

Such a control method allows determining, in real time, an adapted $NPSH_r$ value of the centrifugal pump adapted to its hydraulic parameters during the life time of the pump. The adapted $NPSH_r$ value allows a pump user to prevent the centrifugal pump from being submitted to cavitation or at least to anticipate the cavitation during the life of the centrifugal pump.

Optionally, the specific functional parameter is one of a motor power of the centrifugal pump or a flow of the centrifugal pump.

Such parameters allow implementing the controlling method with centrifugal pump data that are readily available in the hydraulic pump system. Indeed, the flow may be measured by a flowmeter and the motor power may be estimated by a variable speed drive or may be estimated based on a measure of an energy meter.

Optionally, the end-of-line characteristics comprise a plurality of representations, each representation being associated to a specific speed of the centrifugal pump, each representation associating values of a first respective reference parameter to values of a second respective reference parameters, the first respective reference parameter differing from the second respective reference parameter.

Such representation allows determining the evolution of hydraulic parameters of the centrifugal pump and evolution of the $NPSH_r$ value between a state of the centrifugal pump when new and a state of the centrifugal pump at the moment of execution of the method.

Optionally, one of the first or second reference parameters corresponds to the specific functional parameter.

Such reference parameter corresponding to the specific functional parameter allows determining the evolution of hydraulic parameters of the centrifugal pump between the new centrifugal pump and the centrifugal pump at the moment of execution of the method in a direct manner, without having to proceed with a conversion.

Optionally, the first or the second reference parameters correspond to one of a motor power of the centrifugal pump, a flow of the centrifugal pump, a Net Positive Suction Head Required, $NPSH_r$, of the centrifugal pump or a head of the centrifugal pump.

Such first and second reference parameter allows among other determining:

the head difference based on a flow or a motor power of the centrifugal pump, a $NPSH_r$ value based on a head, a flow or a motor power of the centrifugal pump.

Optionally, the specific functional parameter is a functional flow of the centrifugal pump, the plurality of representations comprising a head representation associating values of flow to values of head, and a $NPSH_r$ representation associating values of flow to values of $NPSH_r$, wherein determining the theoretical head comprises selecting a head value of the head representation based on the functional flow of the centrifugal pump;

and wherein determining the $aNPSH_r$ value comprises selecting a $NPSH_r$ value of the $NPSH_r$ representation based on the functional flow of the centrifugal pump.

Such embodiment allows determining the adapted $NPSH_r$ value based on a flow of the centrifugal pump at the functional point.

Optionally, the specific functional parameter is a functional motor power of the centrifugal pump, the plurality of representations comprising a head representation associating values of motor power to values of head and a NPSHr representation associating values of motor power to values of NPSHr, wherein determining the theoretical head comprises selecting a head value of the head representation based on the functional motor power of the centrifugal pump; and wherein determining the aNPSHr value comprises selecting a NPSHr value of the NPSHr representation based on the functional motor power of the centrifugal pump.

Such embodiment allows determining the adapted NPSHr value based on a motor power of the centrifugal pump at the functional point.

Optionally, the $aNPSH_r$ value is obtained by adding the selected $NPSH_r$ value and the head difference.

Such addition allows obtaining the adapted $NPSH_r$ value directly based on a difference of heads between the new centrifugal pump and the centrifugal pump during the method execution and on the $NPSH_r$ of the new pump at the functional point.

Optionally, the specific functional parameter (fp) is a functional flow of the centrifugal pump and wherein the method also comprises:

acquiring the functional flow of the centrifugal pump by a flowmeter.

Such acquisition allows determining the specific functional parameter based on a measure of a sensor.

Optionally, the method also comprises:

pumping, with the centrifugal pump, a fluid having a density higher than the density of water.

Such pumping allows the method to prevent cavitation of the centrifugal pump on hydraulic systems which may be more likely to produce pump damage, such as systems for fluids such as salt water for raising fish and shellfish for example.

Optionally, the method also comprises:

pumping, with the centrifugal pump, a fluid comprising solids.

Such pumping allows the method to prevent cavitation of the centrifugal pump on hydraulic systems which may be more likely to produce pump damage, such as systems for fluid as used in water treatment plant for example.

Optionally, the method also comprises:

determining a Net Positive Suction Head Available value based on the suction pressure; and triggering a cavitation alert when a difference between the Net Positive Suction Head Available value, $NPSH_a$ value, and the $aNPSH_r$ value is below a predetermined threshold.

Such method allows monitoring upcoming cavitation and raising an alert when the $NPSH_a$ value becomes close to the adapted $NPSH_r$ value.

Optionally, depending on the value of the difference between $NPSH_a$ value and the $aNPSH_r$ value, the cavitation alert comprises several levels of alerts.

Such method allows having several types of alerts depending on a level of criticality of the situation.

Optionally, an identification number (ID) is associated to the centrifugal pump (2) and the method also comprises:

storing the aNPSHr along with the identification number (ID) of the centrifugal pump (2) into a memory of a data processing apparatus.

Such method enables collecting statistics such as $NPSH_r$ statistics for sets of centrifugal pumps.

The present disclosure also describes a computer-readable storage medium comprising instructions which, when executed by a processor, cause the processor to carry out any of the methods hereby described. Such processor may for example be a processor of a hydraulic pumping system controller.

The present disclosure also describes a data apparatus comprising a processor adapted to control a hydraulic pumping system according to a control method presented above.

DETAILED DESCRIPTION

Figure 1:
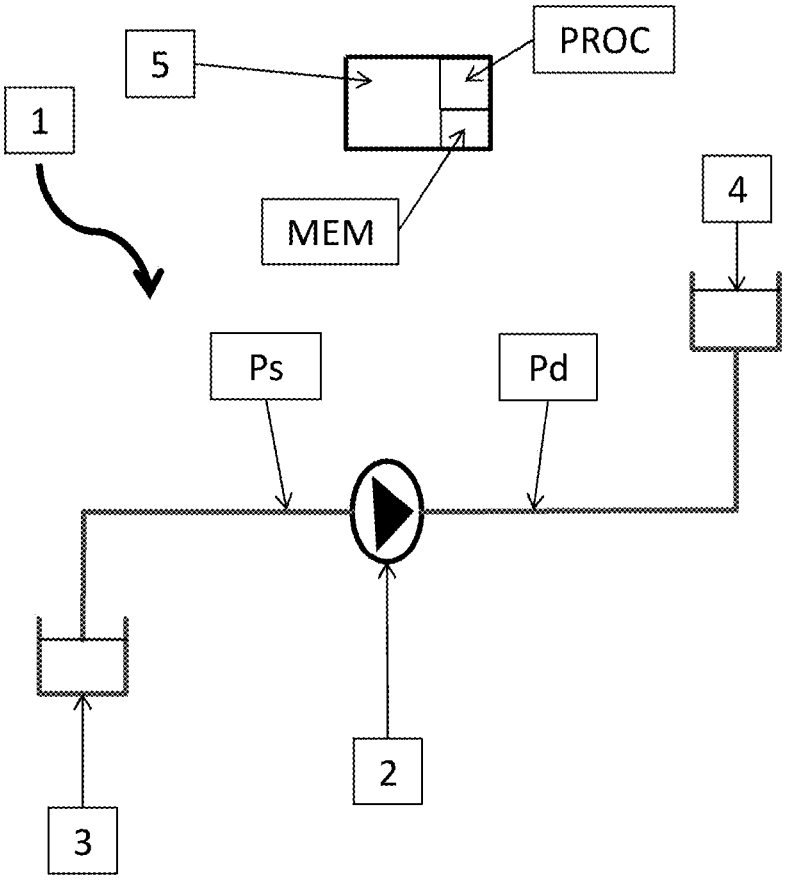
FIG. 1 illustrates an example of a hydraulic pumping system.

The disclosure applies to control methods of a hydraulic pumping system. By hydraulic pumping system, we mean a system for pumping a fluid from a fluid reservoir to another fluid reservoir using a centrifugal pump. For example, a hydraulic pumping system may be a water treatment plant pumping used water, an oil pumping station, a drinking water distribution system or a desalination system. An example of a hydraulic pumping system is represented in FIG. 1. The hydraulic pumping system 1 of FIG. 1 comprises a first fluid reservoir 3 from which a fluid may be pumped by a centrifugal pump 2. The fluid can be water, used water, salt water, oil or other fluids. For example, the fluid may have higher density than water. The fluid may also comprise solids.

The hydraulic pumping system 1 may comprise a second fluid reservoir 4 to which the fluid is pumped. In the example illustrated in FIG. 1, the fluid is pumped from the first reservoir 3 to the second reservoir 4 by the centrifugal pump 2. In some examples, the pumping operation is reversible. Hence, a fluid from the second fluid reservoir 4 can be pumped by the centrifugal pump 2 to the first reservoir 3. As illustrated in FIG. 1, a bottom of the second reservoir 4 is disposed above a bottom of the first reservoir 3 according to gravity. Hence, when the fluid is pumped from the first reservoir 3 to the second reservoir 4, the centrifugal pump 2 is in a suction mode while when the fluid is pumped from the second reservoir 4 to the first reservoir 3, the centrifugal pump is in a charge mode.

The hydraulic pumping system 1 also comprises a discharge pressure sensor (not shown) for measuring a discharge pressure Pd which corresponds to a fluid pressure at a centrifugal pump 2 outlet. The hydraulic pumping system 1 may comprise a suction pressure sensor (not shown) for measuring a suction pressure Ps which corresponds to a fluid pressure at a centrifugal pump 2 inlet. Pressures described in the present disclosure may be expressed in meter water column (mH2O) where one meter water column corresponds to $10^5$ Pascals.

The hydraulic pumping system may comprise a flowmeter for measuring a flow of the centrifugal pump 2. The flow may be expressed in cubic meters per hour ($m^3/h$).

The hydraulic pumping system 1 may comprise a variable speed drive (not shown) for controlling a motor of the centrifugal pump 2. A variable speed drive should be understood as an electronic, virtual or software implemented control unit for a motor of the centrifugal pump 2. The variable speed drive may estimate a motor power of the centrifugal pump 2. The motor power may be expressed in Watt (W). For example, the variable speed drive may apply a determined electric command to a motor of the centrifugal pump 2 for example to reach a determined speed of the motor. The variable speed drive may also measure a response of the motor to the electric command. The variable speed drive may then estimate a motor power based on the determined electric command and on the response of the motor.

The hydraulic pumping system 1 may comprise an energy meter (not shown) for measuring an energy consumption of the centrifugal pump 2. A motor power of the centrifugal pump 2 may be estimated based on a measure of the energy consumption of the centrifugal pump 2.

The hydraulic pumping system 1 may also comprise a data processing apparatus 5 comprising a processor PROC, the processor PROC being configured to operate according to any of the methods hereby described. Processor PROC may comprise electronic circuits for computation managed by an operating system. The data processing apparatus 5 may comprise a non-transitory machine-readable or a computer readable storage medium, such as, for example, memory or storage unit MEM whereby the non-transitory machine-readable storage medium is encoded with instructions executable by a processor such as processor PROC, the machine-readable storage medium comprising instructions to operate processor PROC to perform as per any of the example methods hereby described. A computer readable storage according to this disclosure may be any electronic, magnetic, optical or other physical storage device that stores executable instructions. The computer readable storage may be, for example, Random Access Memory (RAM), an Electrically Erasable Programmable Read Only Memory (EEPROM), a storage drive, and optical disk, and the like. As described hereby, the computer readable storage may be encoded with executable instructions according to any of the methods hereby described. Storage or memory may include any electronic, magnetic, optical or other physical storage device that stores executable instructions as described hereby.

In operation phase of the hydraulic pumping system 1, that is, when the centrifugal pump 2 pumps the fluid from a reservoir to the other reservoir, the centrifugal pump 2 operates at a functional point. The functional point of the centrifugal pump 2 may be associated with functional parameters of the centrifugal pump 2. In other words, the functional parameters characterize the centrifugal pump 2 at a specific functional point. For example, a functional parameter associated to the functional point of the centrifugal pump 2 during operation may be a motor power which may be expressed in Watt (W) or a flow which may be expressed in cubic meters per hour ($m^3/h$) of the centrifugal pump 2. Each of the functional parameter may be associated to a functional speed $\omega_f$ of the centrifugal pump 2 which may be expressed in radians per second (rd/s).

Figure 2:
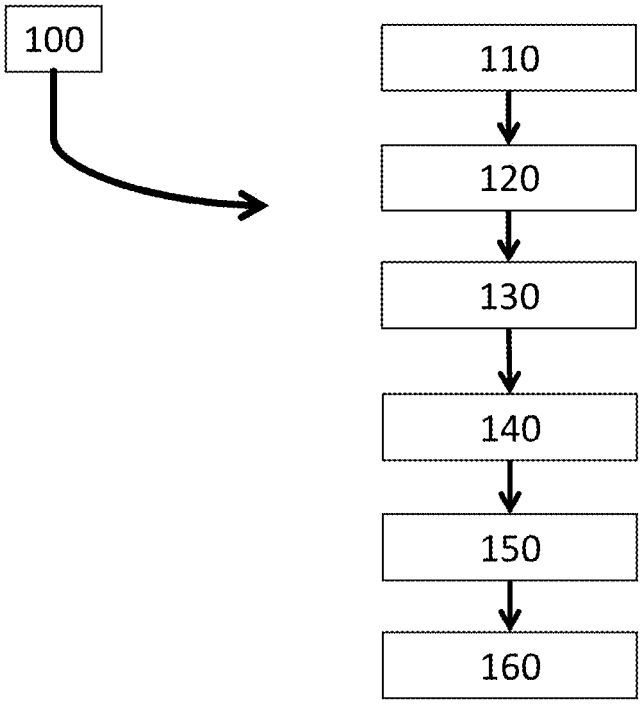
FIG. 2 illustrates an example method.

FIG. 2 illustrates an example of a method 100 for controlling a hydraulic pumping system that can be implemented in the example of hydraulic pumping system 1. The method 100 and other methods hereby presented may be computer implemented methods and may be implemented by the data processing apparatus 5.

The methods for controlling a hydraulic pumping system presented hereby may be implemented in real time during the centrifugal pump operation. In some examples the centrifugal pump 2 is in suction mode during the execution of the methods, that is, the centrifugal pump 2 pumps the fluid against gravity from the first reservoir 3 to the second reservoir 4. In some examples, the methods hereby described may be implemented when the centrifugal pump 2 is in charge mode, i.e. pumping in the same direction as gravity.

Method 100:

With reference to FIG. 2, the method 100 comprises a bloc 110 of estimating a suction pressure Ps of the centrifugal pump 2. The suction pressure Ps corresponds to a fluid pressure at an entry point of the centrifugal pump 2. An entry point of the centrifugal pumps 2 may correspond to a suction flange of the centrifugal pump 2. The suction pressure Ps may therefore correspond to a pressure at an entry point of a suction flange of the centrifugal pump 2. For example, the suction pressure Ps may be estimated based on a measure of a suction pressure sensor or may be estimated based on characteristics of the hydraulic pumping system 1. For example, the suction pressure Ps may be estimated based on a pressure P at the top of the first reservoir 3 (equivalent to the atmosphere pressure in most cases), a gravitational force equivalent value g (more generally known as g-force value), a density ρ of the fluid and a difference of height h between a distance along a vertical axis between the centrifugal pump 2 and the bottom of the first reservoir 3 in the direction of gravity.

As illustrated in bloc 120, the method 100 comprises estimating a discharge pressure Pd of the centrifugal pump 2. The discharge pressure Pd corresponds to a fluid pressure at an exit point of the centrifugal pump 2. In other words, the discharge pressure Pd corresponds to an outlet pressure of the centrifugal pump 2. For example, the discharge pressure Pd may be estimated based on a measure of a discharge pressure sensor.

As illustrated in bloc 130, the method 100 comprises computing a current head $HMT_p$ of the centrifugal pump 2. By current head $HMT_p$, we mean a pressure provided by the centrifugal pump 2 at its functional point.

The current head $HMT_p$ computing is based on the suction pressure Ps and on the discharge pressure Pd. The current head $HMT_p$ may represent a difference between the discharge pressure Pd and the suction pressure Ps at the functional point of the centrifugal pump 2. The current head $HMT_p$ thereby may correspond to a pressure difference between the inlet and the outlet of the centrifugal pump 2 at its functional point. The current head $HMT_p$ may be used as representing a current state of the hydraulic parameters of the centrifugal pump 2. The current $HMT_p$ may be comprised between 0.5 and 200 mH2O.

As illustrated in bloc 140, the method 100 comprises determining a theoretical head $HMT_{th}$ of the centrifugal pump 2. The theoretical head is determined based on a specific functional parameter fp linked to the functional point of the centrifugal pump 2 in the hydraulic pumping system 1 and on end-of-line characteristics of the centrifugal pump 2.

By theoretical head $HMT_{th}$, we mean a theoretical pressure provided by the centrifugal pump 2 when the centrifugal pump 2 is significantly new (at the end-of-line, meaning end of the production line of a new pump) for a functional point corresponding to the functional point of the centrifugal pump 2 during the execution of the method. In other words, the theoretical head $HMT_{th}$ and the current head $HMT_p$ may have significantly the same value at the beginning of the centrifugal pump life. The theoretical head $HMT_{th}$ may be comprised between 0.5 and 200 mH2O.

By specific functional parameter fp linked to the functional point of the centrifugal pump 2, we mean a functional parameter as defined above that is available for the hydraulic pumping system 1. For example, when the hydraulic pumping system 1 comprises a flowmeter, a functional parameter available and characterizing the centrifugal pump 2 for the functional point may be a flow of the centrifugal pump 2. A flow of the centrifugal pump 2 may be comprised between 0 and 600 $m^3/h$. Another example functional parameter available in the hydraulic pumping system 1 may be a motor power of the centrifugal pump 2 when the centrifugal pump 2 is controlled by a variable speed drive or/and when the hydraulic pumping system 1 comprises an energy meter. As said above, the motor power may be estimated by the variable speed drive and may be estimated based on a measure of an energy meter. A motor power of the centrifugal pump 2 may be comprised between 3 and 1000 kW. The specific functional parameter fp may be associated with a functional speed $\omega_f$ of the centrifugal pump 2 for the functional point of the centrifugal pump 2. A functional speed $\omega_f$ of the centrifugal pump 2 may be comprised between 60 and 360 rd/s.

By end-of line characteristics, we mean a plurality of parameters associated to the centrifugal pump 2 at the end-of-line, that is, when the centrifugal pump 2 is significantly new. For example, the end-of line characteristics may be provided by a manufacturer of the centrifugal pump 2 or may be computed on test-benches by a reseller or by a pump user.

For example, the end-of line characteristics may comprise a plurality of representations R associated to a specific speed $\omega_s$ of the centrifugal pump 2. A specific speed $\omega_s$ of the centrifugal pump 2 may be comprised between 60 and 360 rd/s. A representation R may for example be a curve, a table or a list. Each representation R may associate values of a first respective reference parameter rp1 to values of a second respective reference parameters rp2, the first respective reference parameter differing from the second respective reference parameter. The first respective reference parameter rp1 and the second respective reference parameter rp2 may correspond to physical quantities and in particular to hydraulic parameters of the centrifugal pump 2. For example, at least one of the first reference parameters rp1 or second reference parameters rp2 in a representation R may correspond to the specific functional parameter fp. For example, the first respective reference parameter rp1 and/or the second respective reference parameter rp2 may correspond to one of a motor power of the centrifugal pump 2, a flow of the centrifugal pump 2, a $NPSH_r$ of the centrifugal pump 2 or a head HMT of the centrifugal pump 2.

Figure 3:
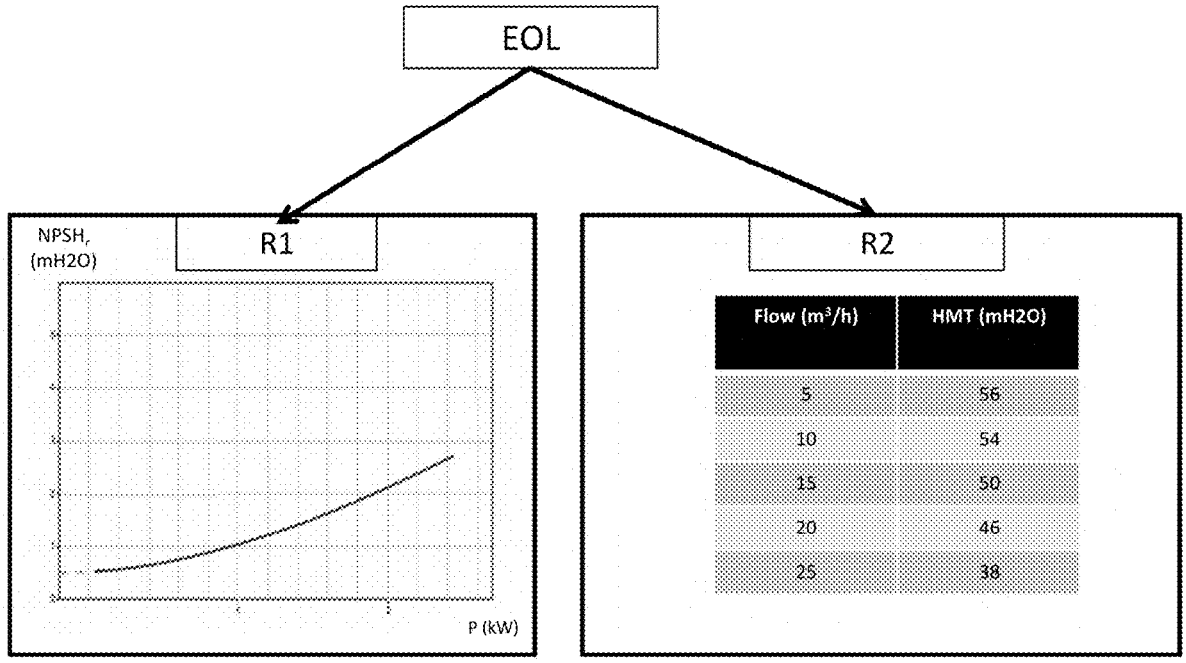
FIG. 3 illustrates an example of end-of-line characteristics comprising representations.

An example of two representations R is illustrated in FIG. 3. End-of-line characteristics are represented by a bloc EOL and comprise a bloc R1 and a bloc R2. Bloc R1 illustrates a curve of $NPSH_r$ values in function of motor power values at a specific speed $\omega_s$ of the centrifugal pump 2. Bloc R2 illustrates a tab of head values HMT associated to flow values at a specific speed $\omega_s$ of the centrifugal pump 2. One should note that the FIG. 3 does not illustrate an exhaustive example of end-of-line characteristics and that the bloc EOL may comprise others blocs (R3, R4, . . . , Rn), for example corresponding to other specific speeds $\omega_s$.

For example, the end-of-line may comprise, for a specific speed $\omega_s$ of the centrifugal pump:

- a head/flow representation $R_{H/f}$ associating values of flow to values of head HMT of the significantly new centrifugal pump 2,
- a $NPSH_r$/flow representation $R_{NPSHr/f}$ associating values of flow to values of $NPSH_r$ of the significantly new centrifugal pump 2,
- a head/power representation $R_{H/P}$ associating values of flow to values of motor power of the significantly new centrifugal pump 2,
- a $NPSH_r$/power representation $R_{NPSHr/P}$ associating values of motor power to values of $NPSH_r$ of the significantly new centrifugal pump 2,
- a flow/power representation $R_{f/P}$ associating values of flow to values of motor power of the significantly new centrifugal pump 2.

It should be understood that the specific functional parameter fp characterizing the functional point of the centrifugal pump 2 may be used to find the head HMT associated to the functional point of the centrifugal pump 2 in the end-of-line characteristics, such said head HMT corresponding to the theoretical head $HMT_{th}$.

One should note that if the specific functional parameter fp does not correspond to one of the first reference parameters rp1 or second reference parameters rp2 associated to head values HMT of the centrifugal pump 2 in the end-of-line characteristics, the specific functional parameter fp may be converted into another functional parameter which is associated to the head values HMT of the centrifugal pump 2 in the end-of-line characteristics. For example, if the specific functional parameter fp is a flow and the end-of-lines characteristics comprise a head/power representation $R_{H/P}$ and a flow/power representation $R_{f/P}$, the flow can be converted to a motor power based on the flow/power representation $R_{f/P}$ to determine the theoretical head $HMT_{th}$ based on the head/power representation $R_{H/P}$.

One should also note that if the specific functional parameter fp is associated to a functional speed $\omega_f$ which is different from the specific speed $\omega_s$ of the plurality of representations R, all or part of each representation R can be converted to the functional speed $\omega_f$. For example, a flow may be proportional to a speed ω of the centrifugal pump 2, a head HMT and a $NPSH_r$ may be proportional to the square of the speed ω of the centrifugal pump 2, and a motor power may be proportional to the cube of the speed ω of the centrifugal pump 2.

As illustrated in bloc 150, the method 100 comprises computing a head difference ∂H between the current head $HMT_p$ and the theoretical head $HMT_{th}$. As said above, in the case where the centrifugal pump 2 is significantly new during the execution of the method, the head difference ∂H may be less than 0.1% of the theoretical head $HMT_{th}$. For example, for a centrifugal pump 2 significantly new, the head difference ∂H may be comprised between 0 and 0.2 mH2O. The head difference ∂H may therefore correspond to the evolution of the hydraulic parameters of the centrifugal pump 2 from the new centrifugal pump 2 to the centrifugal pump 2 during the execution method.

As illustrated in bloc 160, the method 100 comprises determining, for the functional point, an adapted Net Positive Suction Head Required value, or $aNPSH_r$ value.

By adapted $NPSH_r$ value, we mean an updated value of $NPSH_r$ according to the evolution of the hydraulic parameters of the centrifugal pump 2 during its life.

The $aNPSH_r$ value is determined based on the head difference ∂H and on the end of-line characteristics.

The method 100 thereby allows having an updated value of $NPSH_r$ adapted to the hydraulic parameters of the centrifugal pump 2 during the life time of the centrifugal pump 2.

Figure 4:
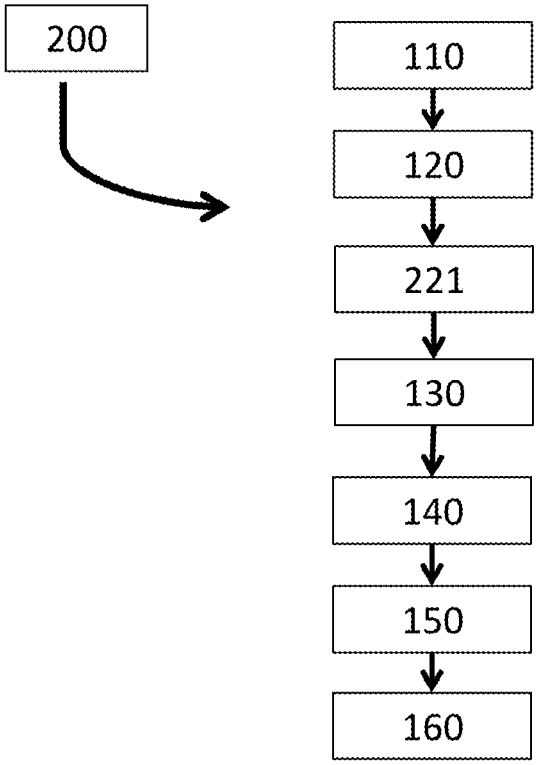
FIG. 4 illustrates a further example method.

Method 200:

An example method 200 is illustrated in FIG. 4. Method 200 comprises blocs 110-160 in line with blocs 110-160 as described in FIG. 2.

In the example method 200, the hydraulic pumping system 1 comprises a flowmeter and the specific functional parameter fp is a functional flow of the centrifugal pump. By functional flow, we mean a flow of the centrifugal pump 2 at the functional point. The method 200 comprises a bloc 221 of acquiring the functional flow of the centrifugal pump 2 by a flowmeter and the specific functional parameter corresponds to the functional flow acquired by the flowmeter. The bloc 221 may be executed at any moment before the bloc 140 of computing the theoretical head $HMT_{th}$.

Figure 5:
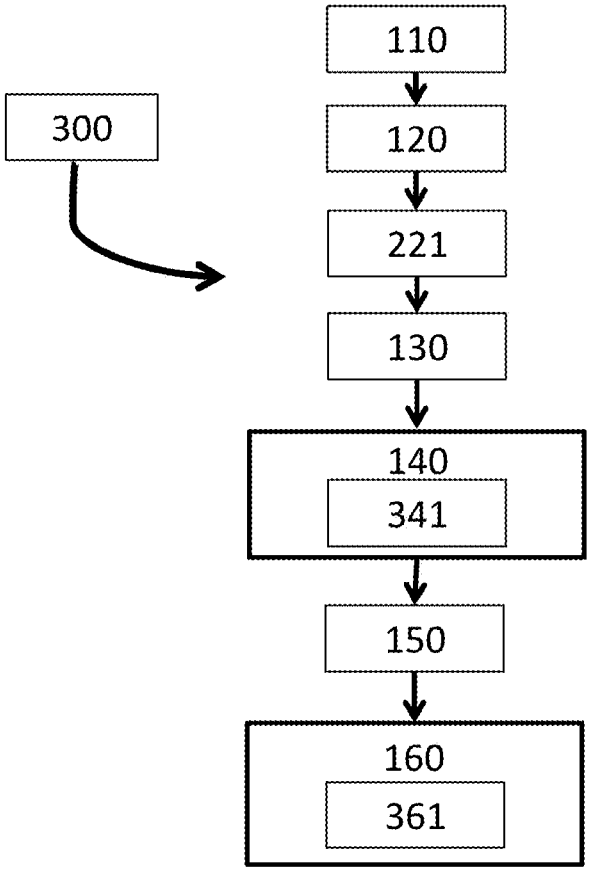
FIG. 5 illustrates yet another example method.

Method 300:

An example method 300 is illustrated in FIG. 5. Method 300 comprises blocs 110-160 and 221 in line with blocs 110-160 and 221 as described in FIGS. 2 and 4. In this embodiment, the end-of-lines characteristics comprise a plurality of representations R. The plurality of representations R comprises a head/flow representation $R_{H/f}$ associating values of flow to values of head HMT and a $NPSH_r$/flow representation $R_{NPSHr/f}$ associating values of flow to values of $NPSH_r$.

In example method 300, the bloc 140 of determining the theoretical head $HMT_{th}$ comprises a sub-bloc 341 of selecting a head value HMT of the head/flow representation $R_{H/f}$ based on the functional flow of the centrifugal pump 2 acquired in the bloc 221. For example, the selected head HMT value may be the head value HMT of the head/flow representation $R_{H/f}$ associated to the same or to the closest flow value of the functional flow value.

In a case where a functional speed $\omega_f$ associated to the functional flow is different from a specific speed $\omega_s$ associated to the head/flow representation $R_{H/f}$, all or part of the head/flow representation $R_{H/f}$ may be converted into the functional speed $\omega_f$ before selecting the head value in the head/flow representation $R_{H/f}$. As said above, the flow can be considered proportional to the speed ω of the centrifugal pump 2 and the head HMT can be considered proportional to the square of the speed ω.

The selected head HMT in the head/flow representation $R_{H/f}$ may correspond to the theoretical head $HMT_{th}$.

In example method 300, the bloc 160 of determining the $aNPSH_r$ value comprises a sub-bloc 361 of selecting a $NPSH_r$ value of the $NPSH_r$/flow representation $R_{NPSHr/f}$ based on the functional flow of the centrifugal pump. For example, the selected $NPSH_r$ value may be the $NPSH_r$ value of the $NPSH_r$/flow representation $R_{NPSHr/f}$ associated to the same or to the closest flow value of the functional flow value.

In a case where a functional speed $\omega_f$ associated to the functional flow is different from a specific speed $\omega_s$ associated to the $NPSH_r$/flow representation $R_{NPSHr/f}$, all or part of the $NPSH_r$/flow representation $R_{NPSHr/f}$ may be converted into the functional speed $\omega_f$ before selecting the $NPSH_r$ value in the $NPSH_r$/flow representation $R_{NPSHr/f}$. As said above, the flow can be considered proportional to the speed ω of the centrifugal pump 2 and the $NPSH_r$ can be considered proportional to the square of the speed ω.

Figure 6:
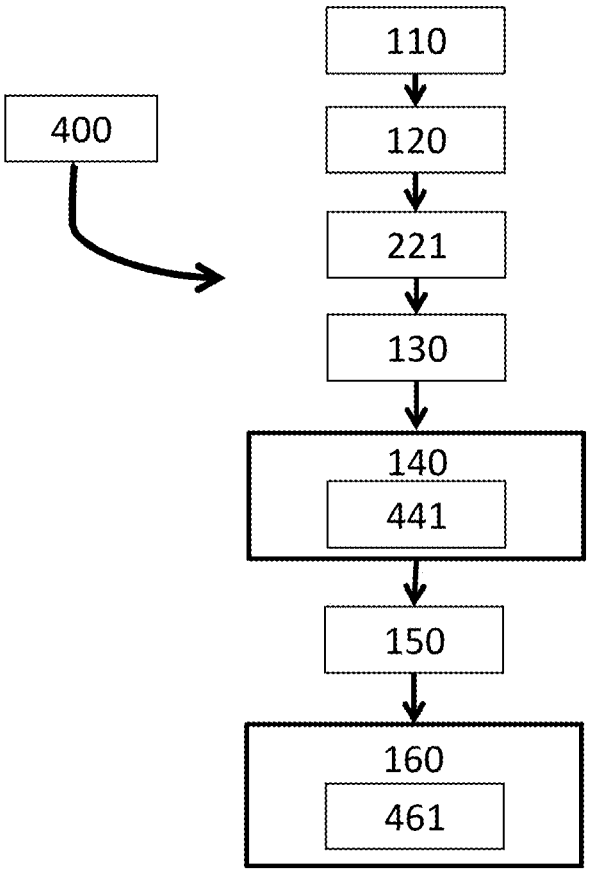
FIG. 6 illustrates yet a further example method.

Method 400:

Another example method 400, which is an embodiment of the method 100 according to this disclose is illustrated in FIG. 6. Method 400 comprises blocs 110-160 in line with blocs 110-160 as described in FIG. 2. In this embodiment, the specific functional parameter fp is a functional motor power of the centrifugal pump 2. By functional motor power, we mean a motor power of the centrifugal pump 2 at the functional point. The functional motor power may be obtained by reading the motor power of the centrifugal pump 2 at the functional point. Also in this embodiment, the end-of-lines characteristics comprise a plurality of representations R. The plurality of representations R comprise a head/power representation $R_{H/P}$ associating values of motor power to values of head HMT and a $NPSH_r$/power representation $R_{NPSHr/P}$ associating values of motor power to values of $NPSH_r$.

In example method 400, the bloc 140 of determining the theoretical head $HMT_{th}$ comprises a sub-bloc 441 of selecting a head value HMT of the head/power representation $R_{H/P}$ based on the functional motor power of the centrifugal pump 2. For example, the selected head HMT value may be the head value HMT of the head/power representation $R_{H/P}$ associated to the same or to the closest motor power value of the functional motor power value.

In a case where a functional speed $\omega_f$ associated to the functional motor power is different from a specific speed $\omega_s$ associated to the head/power representation $R_{H/P}$, all or part of the head/power representation $R_{H/P}$ may be converted into the functional speed $\omega_f$ before selecting the head value in the head/power representation $R_{H/P}$. As said above, the motor power can be considered proportional to the cube of the speed ω of the centrifugal pump 2 and the head HMT can be considered proportional to the square of the speed ω.

The selected head HMT in the head/power representation $R_{H/P}$ may correspond to the theoretical head $HMT_{th}$.

In example method 400, the bloc 160 of determining the $aNPSH_r$ value comprises a sub-bloc 461 of selecting a $NPSH_r$ value of the $NPSH_r$/power representation $R_{NPSHr/P}$ based on the functional motor power of the centrifugal pump. For example, the selected $NPSH_r$ value may be the $NPSH_r$ value of the $NPSH_r$/power representation $R_{NPSHr/P}$ associating to the same or to the closest motor power value of the functional motor power value.

In a case where a functional speed $\omega_f$ associated to the functional motor power is different from a specific speed $\omega_s$ associated to the $NPSH_r$/power representation $R_{NPSHr/P}$, all or part of the $NPSH_r$/power representation $R_{NPSHr/P}$ may be converted into the functional speed $\omega_f$ before selecting the $NPSH_r$ value in the $NPSH_r$/power representation $R_{NPSHr/P}$. As said above, the motor power can be considered proportional to the cube of the speed $\omega$ of the centrifugal pump 2 and the $NPSH_r$ can be considered proportional to the square of the speed $\omega$.

In both methods 300 and 400, the $aNPSH_r$ value may be obtained by adding the selected $NPSH_r$ value selected in a representation $R_{NPSHR/rp}$ associating values of one of the reference parameter (flow or motor power respectively in methods 300 and 400) to $NPSH_r$ values and the head difference $\partial H$.

Figure 7:
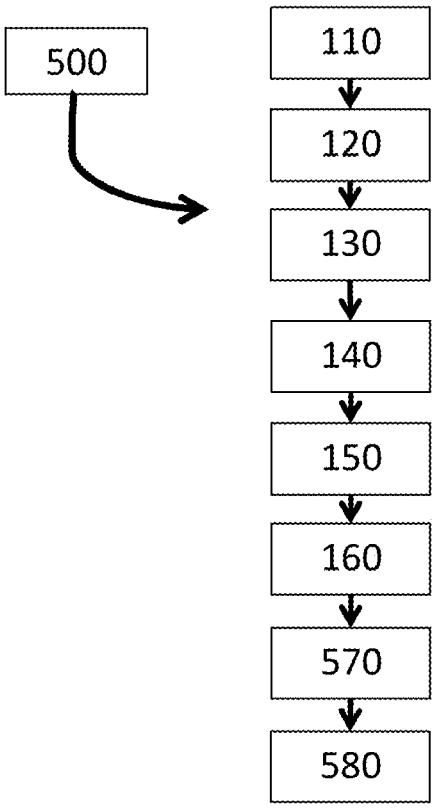
FIG. 7 illustrates an additional example method.

Method 500:

Yet another example method 500 according to this disclosure is illustrated in FIG. 7. Method 500 comprises blocs 110-160 in line with blocs 110-160 as described in FIG. 2. In fact, method 500 may be an embodiment of any of the methods 100 to 400 described above.

The example method 500 comprises a bloc 570 of determining a Net Positive Suction Head Available value $NPSH_a$ based on the suction pressure Ps. By $NPSH_a$ value, we mean a pressure available at a suction flange of the centrifugal pump 2 for the functional point. For example, the $NPSH_a$ value may be obtained based on the suction pressure Ps and on a vaporization pressure of the fluid.

As illustrated in FIG. 7, the method 500 also comprises a bloc 580 of triggering a cavitation alert when a difference between the NPSHa value and the $aNPSH_r$ value is below a predetermined threshold. As said above, when the NPSHa value is below the $aNPSH_r$ value, cavitation appears. The bloc 280 therefore allows preventing or alerting the pump user of cavitation. For example, the threshold may correspond to 0.5 mH2O or may be comprised between 0.2 and 1 mH2O.

In another embodiment of method 500, the cavitation alert comprises several levels of alerts depending on the value of the difference between the $NPSH_a$ value and the $aNPSH_r$ value. For example, a warning alert may be triggered when the difference between the $NPSH_a$ value and the $aNPSH_r$ value is below 0.5 water meter column (mH2O). For example, an alarm alert may be triggered when the difference between the $NPSH_a$ value and the $aNPSH_r$ value is significantly equal to zero. For example, a fault alert may be triggered when the difference between the $NPSH_a$ value and the $aNPSH_r$ value is below minus 0.1 water meter column mH2O. For example, in case of alarm and/or fault alert, the specific speed $\omega_f$ of the centrifugal pump 2 may be decreased.

In an embodiment, each of the example methods presented hereby may comprise pumping, with the centrifugal pump 2, a fluid having a density higher than the density of water and/or comprising solids. For example, the pumped fluid may comprise a density between 1 and 1.2 times the density of the water. Such pumping for example allows preventing cavitation of the centrifugal pump on hydraulic pumping systems dealing with used water in water treatment plant, or with salt water using for raising fish and shellfish.

In an embodiment, the centrifugal pump 2 is associated to an identification number ID. In this embodiment, each of the example methods described hereby may comprise storing the aNPSHr value along with the identification number ID of the centrifugal pump 2 into a memory of a data processing apparatus. Storing the aNPSHr value along with the identification number ID allows building statistics of the evolution of $NPSH_r$ values between different centrifugal pumps. For example, it may be built an average $NPSH_r$ value based on NPSHr values of centrifugal pumps at a determined time of life, the centrifugal pumps being produced by a same production line. The average $NPSH_r$ of centrifugal pumps built from different production lines may be compared to identify a problem on specific production lines. The average $NPSH_r$ value on a production line may also be used to study centrifugal pumps of this production line having a $NPSH_r$ value below the average value $NPSH_r$.

The invention claimed is:

1. A computer implemented method for controlling a hydraulic pumping system, the system comprising a centrifugal pump operating at a functional point, the method comprising:

estimating a suction pressure of the centrifugal pump representing a pressure at an entry point of the centrifugal pump;

estimating a discharge pressure of the centrifugal pump representing a pressure at an exit point of the centrifugal pump;

computing a current head of the centrifugal pump based on the suction pressure and on the discharge pressure;

determining a theoretical head based on a value of a specific functional parameter linked to the functional point of the centrifugal pump in the system and on end of line characteristics of the centrifugal pump;

computing a head difference between the current head and the theoretical head by subtracting a current head value from a theoretical head value, or vice versa; and determining, for the functional point, an adapted Net Positive Suction Head Required valve aNPSHr value, of the centrifugal pump, based on the head difference and on the end of-line characteristics;

wherein the adapted aNPSHr is determined and used in place of a new condition or manufacturer provided Net Positive Suction Head Required value (NPSHr) in real time for controlling the hydraulic pumping system comprising the centrifugal pump operating at the functional point.

2. The method according to claim 1 wherein the specific functional parameter is one of a motor power of the centrifugal pump or a flow of the centrifugal pump.

3. The method according to claim 1 wherein the end of-line characteristics comprise a plurality of representations, each representation being associated to a specific speed of the centrifugal pump, each representation associating values of a first respective reference parameter to values of a second respective reference parameters, the first respective reference parameter differing from the second respective reference parameter.

4. The method according to claim 3 wherein one of the first or second reference parameters corresponds to the specific functional parameter.

5. The method according to claim 3, wherein the first or the second reference parameters correspond to one of a motor power of the centrifugal pump, a flow of the centrifugal pump, a Net Positive Suction Head Required, NPSHr, of the centrifugal pump or a head of the centrifugal pump.

6. The method according to claim 3 wherein the specific functional parameter is a functional flow of the centrifugal pump, the plurality of representations comprising a head/flow representation associating values of flow to values of head, and a NPSHr/flow representation associating values of flow to values of NPSHr, wherein determining the theoretical head comprises selecting a head value of the head/flow representation based on the functional flow of the centrifugal pump; and wherein determining the aNPSHr value comprises selecting a NPSHr value of the NPSHr/flow representation based on the functional flow of the centrifugal pump.

7. The method according to claim 3 wherein the specific functional parameter is a functional motor power of the centrifugal pump, the plurality of representations comprising a head/power representation associating values of motor power to values of head and a NPSHr/power representation associating values of motor power to values of NPSHr, wherein determining the theoretical head comprises selecting a head value of the head/power representation based on the functional motor power of the centrifugal pump; and wherein determining the aNPSHr value comprises selecting a NPSHr value of the a NPSHr/power representation based on the functional motor power of the centrifugal pump.

8. The method according to claim 6 wherein the aNPSHr value is obtained by adding the selected NPSHr value and the head difference.

9. The method according to claim 1 wherein the specific functional parameter is a functional flow of the centrifugal pump and wherein the method also comprises:

acquiring the functional flow of the centrifugal pump by a flowmeter.

10. The method according to claim 1 wherein the method also comprises:

pumping, with the centrifugal pump, a fluid having a density higher than the density of water, and/or pumping, with the centrifugal pump, a fluid comprising solids.

11. The method according to claim 1, wherein the method also comprises:

determining a Net Positive Suction Head Available value, NPSHa value, based on the suction pressure; and triggering a cavitation alert when a difference between the NPSHa value and the aNPSHr value is below a predetermined threshold.

12. The method according to claim 11, wherein the cavitation alert comprises several levels of alerts depending on the value of the difference between the NPSHa value and the aNPSHr value.

13. The method according to claim 1, wherein an identification number is associated to the centrifugal pump and the method also comprises:

storing the aNPSHr value along with the identification number of the centrifugal pump into a memory of a data processing apparatus.

14. A non-transitory computer-readable storage medium comprising instructions which, when executed by a processor, cause the processor to carry out the method of claim 1.

15. A data processing apparatus comprising a processor configured to control a hydraulic pumping system according to the method of claim 1.

* * * * *